US007128221B2

(12) United States Patent
Metcalf

(10) Patent No.: US 7,128,221 B2
(45) Date of Patent: Oct. 31, 2006

(54) ADJUSTABLE CANTILEVERED SHELF

(75) Inventor: Derek Metcalf, Burr Ridge, IL (US)

(73) Assignee: Rock-Tenn Shared Services LLC, Norcross, GA (US)

( * ) Notice: Subject to any disclaimer, the term of this patent is extended or adjusted under 35 U.S.C. 154(b) by 242 days.

(21) Appl. No.: 10/699,396

(22) Filed: Oct. 30, 2003

(65) Prior Publication Data

US 2005/0092701 A1 May 5, 2005

(51) Int. Cl.
*A47F 1/04* (2006.01)
*A47B 47/00* (2006.01)

(52) U.S. Cl. ..... 211/59.2; 211/106; 211/103; 211/187; 211/193; 211/208; 211/90.03

(58) Field of Classification Search ..... 211/59.2, 211/106, 106.01, 181.1, 207, 208, 187, 190, 211/193, 103, 126.2, 126.5, 126.9, 133.1, 211/133.2, 133.5, 112, 90.01–90.04; 108/1, 108/5, 7, 108; 248/242, 243, 245
See application file for complete search history.

(56) References Cited

U.S. PATENT DOCUMENTS

| | | | | | |
|---|---|---|---|---|---|
| 573,835 | A | | 12/1896 | Taylor | |
| 1,428,730 | A | | 9/1922 | Weston | |
| 1,829,009 | A | | 10/1931 | Madsen | |
| 2,648,442 | A | | 8/1953 | Lowmaster | |
| 3,174,627 | A | | 3/1965 | Marschak | |
| 3,182,945 | A | | 5/1965 | Sedo | |
| 3,248,079 | A | | 4/1966 | Kennedy | |
| 3,280,989 | A | * | 10/1966 | Melvin et al. | 211/133.2 |
| 3,501,020 | A | | 3/1970 | Krikorian | |
| 3,572,626 | A | * | 3/1971 | Bertschi | 248/242 |
| 3,701,325 | A | | 10/1972 | Fenwick | |
| 3,760,744 | A | | 9/1973 | Crucksbank | |
| 3,795,379 | A | | 3/1974 | Gray | |
| 3,915,097 | A | | 10/1975 | Young, Jr. | |
| 3,993,002 | A | * | 11/1976 | Stroh | 108/108 |
| 4,065,088 | A | | 12/1977 | Shell | |
| 4,155,312 | A | | 5/1979 | Thorkildson | |
| 4,248,352 | A | | 2/1981 | White | |
| 4,250,815 | A | | 2/1981 | Swanson | |
| 4,307,671 | A | * | 12/1981 | Albano | 108/6 |
| 4,378,925 | A | | 4/1983 | Griffin | |
| 4,492,169 | A | | 1/1985 | Ware et al. | |
| 4,500,146 | A | | 2/1985 | Peterson | |

(Continued)

FOREIGN PATENT DOCUMENTS

EP 0 442 398 A1 8/1991

(Continued)

*Primary Examiner*—Jennifer E. Novosad
(74) *Attorney, Agent, or Firm*—Kilpatrick Stockton LLP

(57) ABSTRACT

An adjustable shelf assembly for displaying product. The shelves can be oriented in horizontally or in a forward sloping position with a simple adjustment. The shelves are generally rectangular and comprise upper and lower mounting pins located on each side of the shelf, extending downwardly from the rear edge of the shelf. The mounting pins are vertically spaced and slightly offset from one another. The mounting pins are used to mount the shelf on a support frame comprising a plurality of openings along the vertical members of the frame. The upper mounting pins are placed in first openings along the frame. The lower mounting pins are positionable either flush against the front surface of the vertical members to position the shelf in a horizontal orientation or inside second openings along the frame to position the shelf in a forward sloping orientaion.

7 Claims, 3 Drawing Sheets

U.S. PATENT DOCUMENTS

| | | | | |
|---|---|---|---|---|
| 4,553,523 | A | 11/1985 | Stohrer | |
| 4,583,648 | A | 4/1986 | Buffington et al. | |
| 4,730,738 | A | 3/1988 | Bartus et al. | |
| 5,199,579 | A | 4/1993 | VanDuyne | |
| 5,205,421 | A * | 4/1993 | Bustos | 211/59.2 |
| 5,449,076 | A | 9/1995 | Van Moord | |
| 5,450,971 | A | 9/1995 | Boron et al. | |
| 5,460,345 | A | 10/1995 | Trevaaskis | |
| 5,547,088 | A * | 8/1996 | Belokin et al. | 211/87.01 |
| 5,641,083 | A | 6/1997 | Metcalf | |
| 5,769,247 | A * | 6/1998 | Merl | 211/103 |
| 5,816,419 | A | 10/1998 | Lamson | |
| 6,070,841 | A | 6/2000 | Robinson | |
| 6,109,462 | A | 8/2000 | Emalfrb et al. | |
| 6,142,321 | A | 11/2000 | West | |
| 6,189,527 | B1 | 2/2001 | Walsh et al. | |
| 6,332,548 | B1 | 12/2001 | West et al. | |
| 6,341,704 | B1 | 1/2002 | Michel | |
| 6,357,609 | B1 * | 3/2002 | Van Noord et al. | 211/90.02 |
| 6,641,098 | B1 * | 11/2003 | Proffitt | 248/243 |
| 6,666,344 | B1 | 12/2003 | Schneider | |
| 6,726,035 | B1 * | 4/2004 | Zadak | 211/90.03 |
| 2002/0027115 | A1 | 3/2002 | Gay et al. | |
| 2005/0039641 | A1 | 2/2005 | Metealf | |

FOREIGN PATENT DOCUMENTS

| | | |
|---|---|---|
| FR | 2 548 529 | 11/1985 |
| WO | WO 90/02500 | 3/1990 |

* cited by examiner

ADJUSTABLE CANTILEVERED SHELF

FIELD OF THE INVENTION

The invention relates to adjustable display units for displaying products at retail establishments and, more particularly, to a display shelf adjustable between a horizontal display position and a forward sloping display position.

BACKGROUND

Cantilevered display shelves are a popular and convenient way to display merchandise in a retail store environment. Typically, a vertical set of supports allows the shelves to be selectively positioned in a variety of heights and spacings.

Retailers may prefer to display different types of products in different orientations. Some products, for example, appear more enticing and are better displayed on a forward sloping shelf so that a perspective view of the product is available to the customer. Other products may preferably be displayed on a flat horizontal shelf due to varying marketing strategies or logistical requirements, for example due to product packaging configuration. Therefore, having an adjustable shelf would allow a retailer to accommodate both display styles with a single shelving unit. An adjustable shelf unit would also permit retailers to use the shelf unit in different configurations at different times to best suit the product being displayed.

Many existing adjustable display shelves involve complex or intricate structures to allow the adjustment of the display shelf, including numerous parts. Such designs make the adjustable shelves more difficult to produce and use. For example, special tooling may be required to manufacture the adjustable shelf, and if the manufacturer desires to change the slope angle of the shelf, the tooling may need to be readjusted. These tooling and design considerations add to the expense of such adjustable shelving units.

Existing adjustable shelf units may be difficult to use. A retailer desiring to switch a display shelf from a horizontal position to a forward sloping position may have to make laborious adjustments in order to do so. This causes increased labor costs for the retailer who must allot employee hours to make the appropriate adjustments. Alternatively, the retailer may simply forego the advantage the adjustable shelf attempts to provide in order to avoid making the adjustments.

Thus there is a need for a practically designed and easy to use adjustable cantilevered shelf.

SUMMARY

Certain embodiments of the present invention provide an adjustable shelf unit. Each shelf is preferably rectangular. Mounting rails are located on each side of the shelf. The mounting rails comprise a top rail and a bottom rail. An upper mounting pin extends from the rear portion of the top rail and a lower mounting pin extends from the rear portion of the bottom rail. The top rail is preferably slightly longer than the bottom rail, causing the upper mounting pin and the lower mounting pin to be slightly offset.

According to certain embodiments of the present invention, a support frame comprises a base and two vertical members connected at the top by a horizontal member. The vertical members each have a front receiving surface containing a plurality of equally spaced apart openings. The shelves can be attached to the support frame causing the shelf to be either horizontal or forwardly sloping. In order for the shelves to be horizontal, the upper mounting pins of a shelf are first placed in first openings of the vertical members. The lower mounting pins are then placed flush against the front receiving surface of the vertical members. The offset of the upper and lower mounting pins causes the shelf to remain in a horizontal orientation when mounted to the support frame in this manner. If it is desired for the shelf to be forward sloping, the upper mounting members are again placed in first openings and the lower mounting pins are placed in second openings located below the first openings. Again, due to the offset of the upper and lower mounting pins, the shelf is sloped forward when mounted in this manner.

Certain embodiments of the present invention allow retailers using cantilevered display shelves to quickly and easily adjust individual shelves in order to best display a particular product. By selectively positioning a lower mounting pins either inside an opening or flush against the surface of the vertical member, a retailer can easily adjust the orientation of the shelf to achieve the desired display effect. The design is easy to use, has minimal parts needing adjustment, and allows retailers with great flexibility when displaying product.

DETAILED DESCRIPTION

Figure 1:
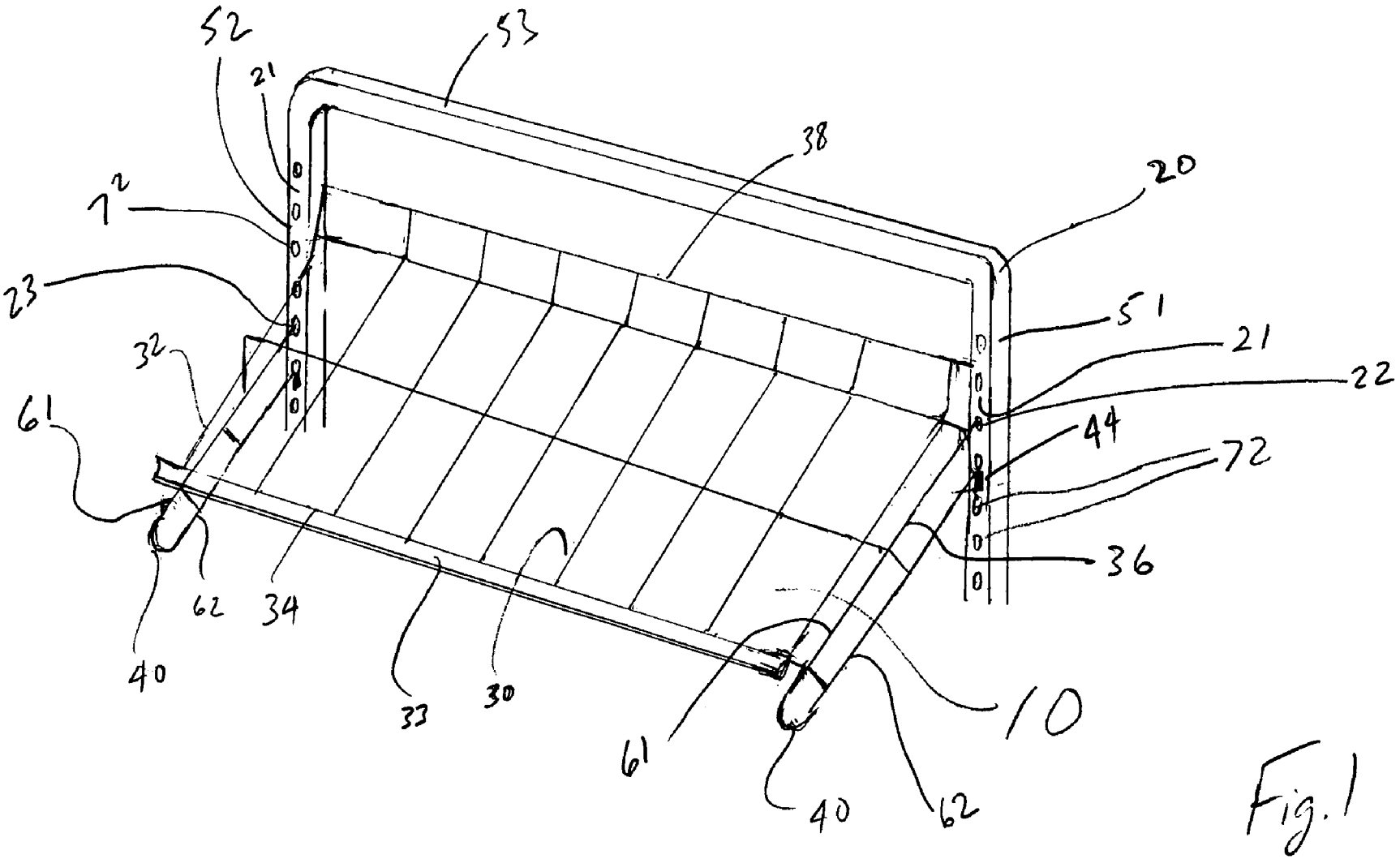
FIG. 1 is a perspective view of the adjustable cantilevered shelf.
Figure 2:
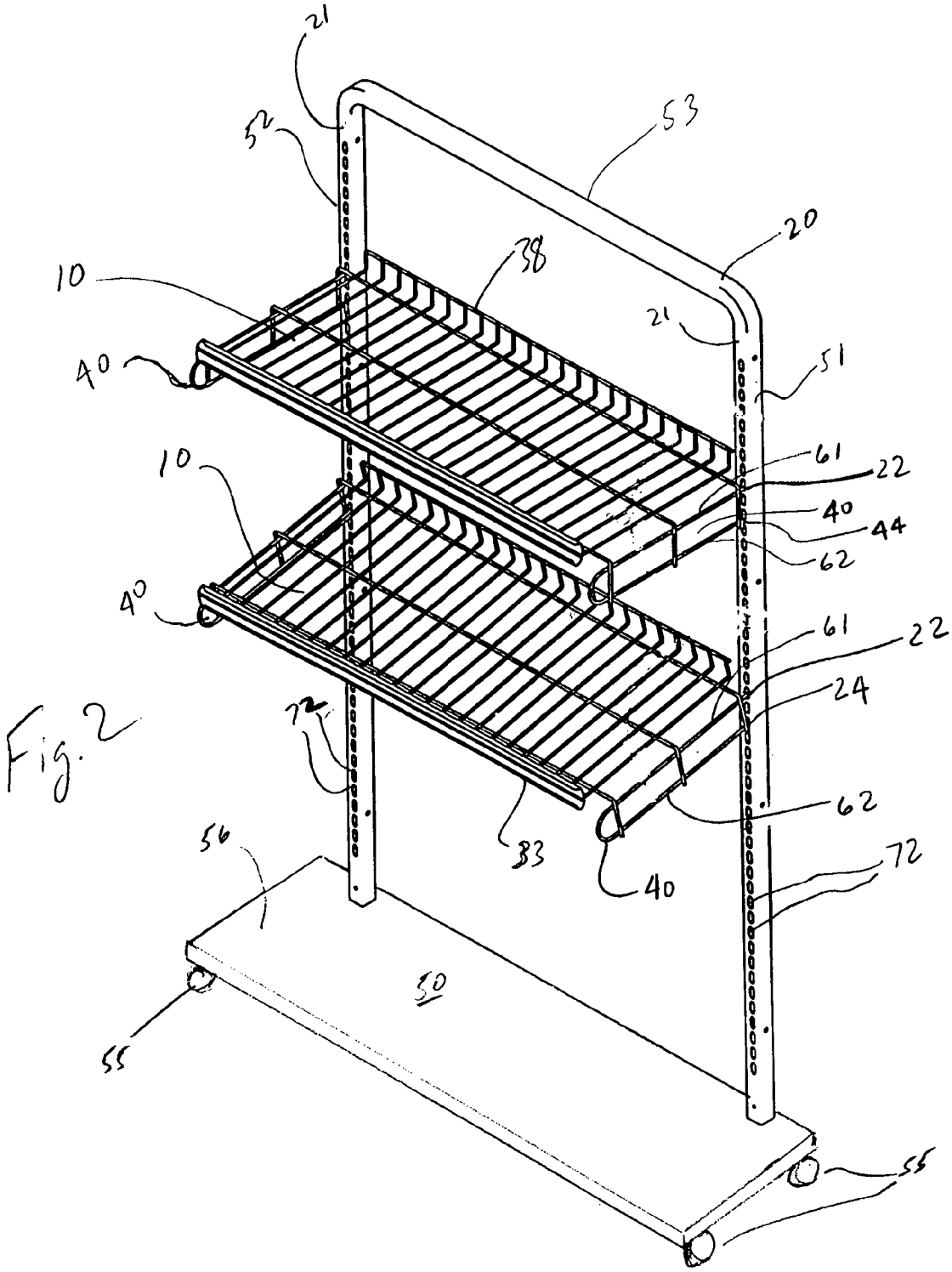
FIG. 2 is a perspective view of the adjustable cantilevered shelf and support frame.

Certain embodiments of the present invention provide an adjustable cantilevered shelf 10. As shown in FIGS. 1 and 2, the adjustable cantilevered shelf 10 comprises a top surface 30. The top surface 30 is bounded by two side edges 32 and 36, a front edge 34, and a rear edge 38. The top surface 30 is intended to receive merchandize or other items for display. According to certain embodiments of the present invention, the shelf 10 is formed from lengths of parallel spaced solid cylindrical metal rods and transverse spaced solid cylindrical rods forming a grid-like arrangement. One skilled in the art would understand that the shelf may be made from other suitable material if desired.

According to certain embodiments of the present invention, the shelf 10 comprises a pair of mounting rails 40. One mounting rail 40 extends from either side of the shelf. According to the certain embodiments of the present invention, each mounting rail is formed by a single length of wire and is part of the cylindrical metal rods forming the shelf. The single wire design allows for efficient and simple manufacturing of the mounting rail and a minimum number of adjustable parts. Each mounting rail 40 comprises a top rail 61 and a bottom rail 62. An upper mounting pin 42 and a lower mounting pin 44 extending from the rear portion of the top rail and bottom rail respectively. The upper mounting pin 42 and lower mounting pin 44 preferably extend downwardly from the rear edge of the mounting rail, thereby forming a single bend. The single bend is preferably substantially a right angle according to certain embodiments of the present invention. The top rail is preferably slightly longer than the bottom rail causing the upper mounting pin and lower mounting pin to be slightly offset from one another. That is, the upper mounting pin is positioned slightly more rearwardly than the lower mounting pin. This allows the shelf to be adjustable as will be described further.

According to certain embodiments of the present invention, the front edge 34 of the shelf 10 is bent upwards at substantially a right angle. Products placed on the shelf may rest against the front edge of the shelf, particularly when the shelf is oriented at an angle. The front edge 34 is therefore configured to provide support to displayed items when the shelf is in a forward sloping position. According to certain embodiments, the front edge 34 comprises an elongated frame 33. The elongated frame 33 preferably extends the length of the front edge 34 of the shelf. The elongated frame is preferably configured to receive advertising or other indicia along the front edge 34 of the shelf 10.

Certain aspects of the present invention comprise a support frame 20. The support frame is preferably generally U-shaped according to certain embodiments of the present invention. The support frame comprises a base surface 50 having an upper surface 56 and a bottom surface (not shown). Wheels 55 may preferably be attached to the bottom surface of the base to facilitate movement of the support frame according to certain embodiments of the present invention.

The display frame, according to certain embodiments of the present invention, comprises two vertical members 51, 52 extending upward from each side of the base 50. The two vertical members are connected by a horizontal member 53 that extends between the top of each vertical member. Each vertical member comprises a front receiving surface 21. The front receiving surface 21 of the vertical members contain a plurality of receiving openings 72. The openings are preferably evenly spaced along the front receiving surface.

The shelf 10 may be attached to the support frame 20 and placed in the retail establishment to display product for sale. To secure the shelf to the display frame, each upper mounting pin 42 of the mounting rail 40 is placed inside first openings 22, 23 in the front receiving surface 21 of the display frame. The first openings are each located on one of the vertical members and are at the same vertical location. The placement of the lower mounting pin 44 with respect to the front receiving surface 21 determines the orientation of the shelf 10. If a horizontal, substantially flat orientation of the shelf 10 is desired, the lower mounting pin 44 is placed flush against the front receiving surface 21 of the receiving structure 20. The lower mounting pin therefore simply rests against the front receiving surface 21. Due to the offset of the upper mounting pins and the lower mounting pins, the lower mounting pin can rest against the front receiving surface and resist downward forces acting on the shelf when product is placed on the shelf. It should be understood that the amount of offset of the upper mounting pin and the lower mounting pin is preferably approximately equal to the thickness of the front receiving surface.

Figure 3:
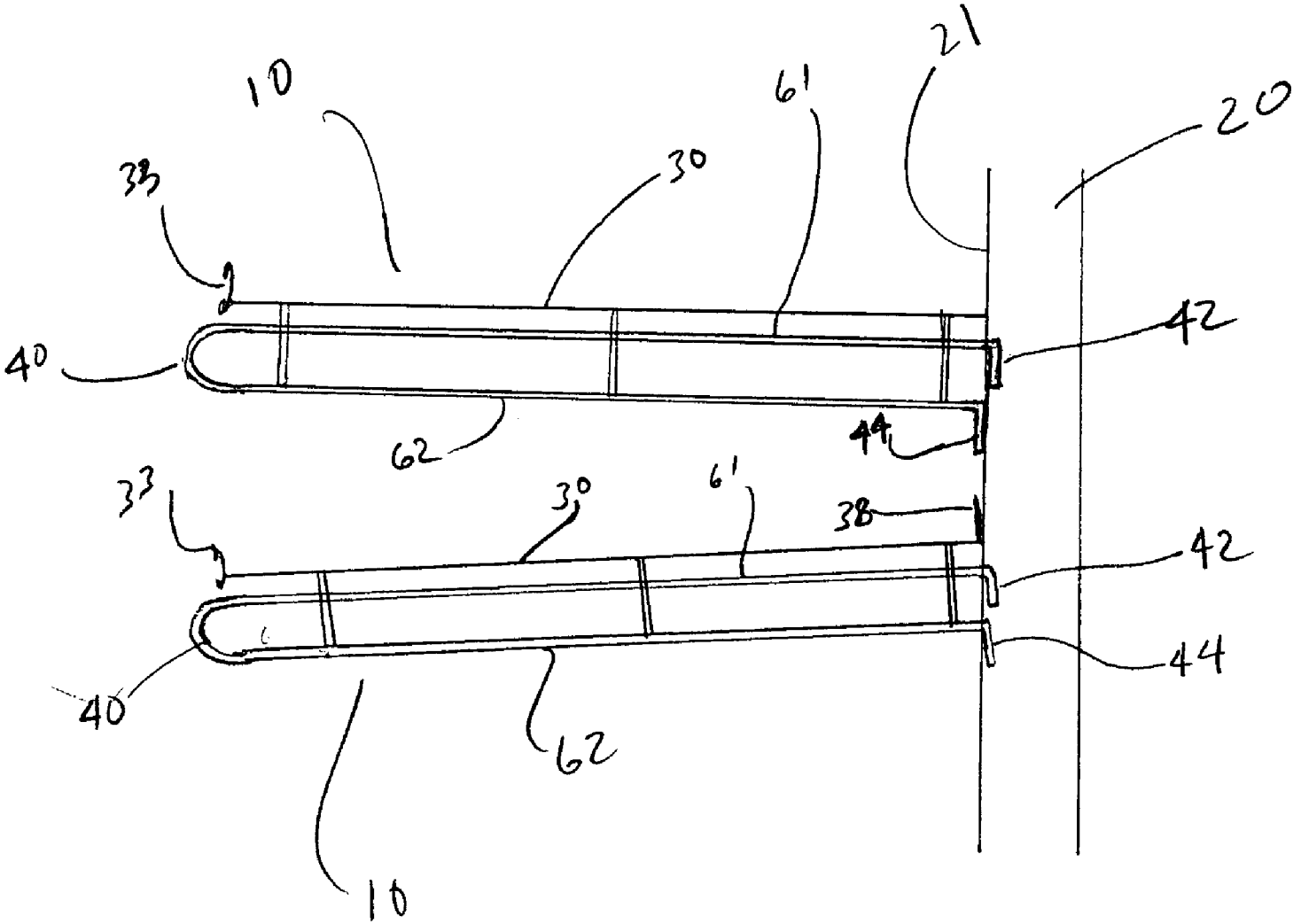
FIG. 3 is a broken away side view showing the adjustable shelf in horizontal and forward sloping orientation.

If it is desired to orient the shelf at a forward sloping angle, each of the lower mounting pins are placed into second openings 24, 25 in the front receiving surface 21, located below the first opening as shown in FIG. 3. The second openings are located at the same vertical location on each vertical member of the display frame.

According to certain embodiments of the present invention, the openings in the front receiving surface 21 are equally spaced along the front receiving surface such that any two receiving openings may be utilized as the first and second openings 22, 23, 24 and 25. It should also be understood that the shelf may be attached to a standard peg board and used in the same manner as described above to achieve various orientations.

The manufacturer may adjust the degree of the forward slope of the shelf by adjusting the relative position of the lower mounting pin 44 with respect to the upper mounting pin 42. Because the upper and lower mounting pins 42 and 44 are each formed by a single bend in respective ends of a single length of wire that comprises the mounting rail 40, the relative positioning of the upper mounting pin 42 and lower mounting pin 44 may be easily adjusted without additional tooling and significant changes in the manufacturing process.

What is claimed is:

1. An adjustable cantilevered shelving unit comprising:

a generally planar shelf comprising;

a mounting rail extending from each side of the shelf, the mounting rails comprising a top rail and a bottom rail;

an upper mounting pin extending downwardly from the rear edge of each top rail and a lower mounting pin extending downwardly from the rear edge of each bottom rail, the upper and lower mounting pins being offset, wherein the mounting rail, upper mounting pin, and lower mounting pin are formed from a single rod; and a support frame comprising a base, two vertical members and a horizontal member, the vertical members each comprising a plurality of evenly spaced apart openings on a front receiving surface of the vertical members;

whereby the shelf is mountable to the support frame by inserting the upper mounting pins in first openings of the receiving surface and the lower mounting pins are selectively positionable either against the front receiving surface of the vertical member causing the shelf to be oriented in a substantially horizontal orientation or inside second openings on the front receiving surface of the vertical member causing the shelf to be oriented in a forward sloping orientation.

2. The adjustable cantilevered shelf of claim 1, wherein a relative positioning of the lower mounting pin with respect to the upper mounting pin determines a degree of the forward sloping orientation of the shelf.

3. The adjustable cantilevered shelf of claim 1, wherein the upper mounting pin and lower mounting pin each comprise a bend in the single rod forming the mounting rail, upper mounting pin and lower mounting pin.

4. The adjustable cantilevered shelf of claim 1, wherein the front edge of the shelf bends upward at approximately a right angle and provides support for displayed items when the shelf is in the forward sloping orientation.

5. The adjustable cantilevered shelf of claim 1, wherein the front edge of the shelf comprises a frame for receiving indicia.

6. The adjustable cantilevered shelf of claim 1, wherein the top rail is longer than the bottom rail.

7. The adjustable cantilevered shelf of claim 1, wherein the single rod is a solid cylindrical metal wire.

* * * * *